US007044291B1

(12) United States Patent
Mumford

(10) Patent No.: US 7,044,291 B1
(45) Date of Patent: May 16, 2006

(54) GLUE TOTE

(76) Inventor: Harry James Mumford, 2527 Jimmy Conner Pl., Bryceville, FL (US) 32009

( * ) Notice: Subject to any disclaimer, the term of this patent is extended or adjusted under 35 U.S.C. 154(b) by 412 days.

(21) Appl. No.: 10/681,436

(22) Filed: Oct. 8, 2003

(51) Int. Cl.
*A44B 7/00* (2006.01)

(52) U.S. Cl. ..... 206/81; 206/560; 206/564; 206/446; 24/530; 220/752; 294/137; 294/162; 294/148

(58) Field of Classification Search ..... 206/81, 206/839, 53, 54, 426, 446, 229, 564, 560; 24/530, 535; 220/752, 756, 775, 757, 762, 220/23.4; 294/137, 162, 153, 148; 211/79
See application file for complete search history.

(56) References Cited

U.S. PATENT DOCUMENTS 2,727,325 A * 12/1955 Jurinic ..... 118/503
2,956,813 A * 10/1960 Madden ..... 280/815
2,997,900 A * 8/1961 Pugsley ..... 408/95
4,214,684 A * 7/1980 Galowitz ..... 294/161
4,277,006 A * 7/1981 Pinckard ..... 294/145
4,721,222 A 1/1988 Haythornthwaite
4,901,846 A * 2/1990 Lehman ..... 206/1.8
5,042,757 A * 8/1991 Jenkins et al. ..... 248/75
5,125,506 A 6/1992 Galbierz
5,348,276 A * 9/1994 Blacker ..... 269/88
5,603,427 A * 2/1997 Truchon et al. ..... 220/259.5
5,806,736 A 9/1998 Kincart
5,921,645 A * 7/1999 Lapi ..... 312/245
5,979,840 A * 11/1999 Hollister et al. ..... 248/76
6,036,020 A * 3/2000 Distler ..... 206/564

* cited by examiner

*Primary Examiner*—Jila M. Mohandesi
*Assistant Examiner*—Steven B. Pollicoff
(74) *Attorney, Agent, or Firm*—Lawrence J. Gibney, Jr.

(57) ABSTRACT

The embodiment of this invention is disclosed, which describes a device to carry two cans at one time in a secure fashion. This invention allows the user of the device to carry either pint or quart sized cans to any site in a secure fashion. It rests on a base, which will allow the user to lay it on a level surface. The cans themselves are securely fastened to the device using a spring, which is located between the bottom of a handle and the top surface of a clamp. A T-handle allows the user to carry the device from site to site.

9 Claims, 5 Drawing Sheets

(510)
(500)
(700)
(400)
(215)
(210)
(200)
(220)
(210)
(220)
(300)
(100)
(100)
(600)
(800)

(700)
(300)
(510)
(500)
(400)
(200)
(210)
(220)
(210)
(220)
(215)
(100)

GLUE TOTE

CROSS REFERENCES TO RELATED APPLICATIONS

None

STATEMENT REGARDING FEDERALLY SPONSORED RESEARCH

No federal research money was used in the development of this invention.

REFERENCE TO APPENDIX

No appendix accompanies this application

BACKGROUND OF THE INVENTION

Certain tradesman, particularly construction workers, are required to bring various materials to job sites. Sometimes the necessary equipment is in bags, bottles, rolls or cans. This device allows the worker to carry two same sized cans in a handy carrying device. This application will describe how a plumber for instance will use the device.

Most plumbers are very familiar with PVC (Polyvinyl Chloride) piping or coated PVC. It is lightweight, very durable and is very commonly used in houses and outdoor applications such as irrigation systems. However, in order to connect the PVC together the plumber must apply both a cleaner and a glue to the pipe in order to make a secure and tight fit of the pieces of PVC piping.

Without the use of the glue and the cleaner the piping becomes brittle and fails. The material that is used to clean and glue the pipe together are liquids, which are applied to the PVC to connect the piping. These materials (cleaner and glue) are stored in cans—pint size, quart size, or even gallon or drum size. Usually a plumber carries a pint or quart size can to a job site due to convenience and ease of transport.

At times plumbers like construction workers are required to work in cramped outdoor spaces particularly in ditches when they are connecting the PVC piping. The environment is dirty and often has uneven surfaces. One of the risks in the field for the plumber is that the plumber may accidentally knock the can of cleaner or glue over. This results in waste of the product and waste of time for the plumber.

Since both the cleaner and the glue must be applied to the PVC pipe in order to make a secure fit, the plumber must carry at least two cans—one for the cleaner and one for the glue.

The purpose of this invention is to ensure that a plumber, for instance, can carry either a pint or quart size can of the glue and the same size can of cleaner to the job site at one time in a handy carrying device. The cans are securely attached on the bottom of the device in a recessed concentric circles and clamped on the top of the can lid with a recessed groove on a spring-loaded clamp. The recessed groove, which is on the underside of the clamp fits over the top of the can. A T handle on the top of the device allows the plumber to carry the device.

The typical can of glue and cleaner has an applicator in the middle of the can. The applicator is inserted into the liquid and allows the cleaner or the glue to be applied to the pipe. The plumber removes the applicator from the respective can, applies the particular material (either cleaner or glue), and then securely puts the applicator back in the appropriate can. It is very important to prevent foreign material from entering the can with the glue or the cleaner. It is also very important that the can of cleaner or glue remain as airtight as possible. Both the presence of foreign material and air will destroy the cleaner and glue.

The bottom surface of the base of the device is a flat surface, which allows the plumber to rest the device on any surface. The downward pressure of the spring between the handle and the clamp of the device would ensure that both cans remain in place in the device.

This device may be used in any application where two cans must be carried at once. This is not particularly limited to the plumbing trade, but may also be used in other construction trades, woodworking facilities or any application where cans must be carried to a job site. The example of the plumber in this application was used solely for illustration purposes.

BRIEF SUMMARY OF THE INVENTION

This is a device, which allows two cans, either pint or quart sized to be carried at one time in a secure fashion. The bottom of the device is either aluminum or molded plastic. A spindle in the center of the device is screwed into a tapped and threaded hole in the bottom or base of the device at one end and secured at the other by a hex nut. The spindle is threaded at both ends to achieve that result.

Between the handle and the base of the device is a clamp, which is used to secure the pint or quart size cans to the device. On the underside of the clamp recessed grooves are provided. These grooves fit over the lip of the cans.

A spring is located between the underside of the handle and the top surface of the clamp of the device. On the point of contact with the top of the cans the clamp has a recessed or grooved lip, which allows the clamp to fit over the lip of the container. The downward pressure of the spring insures a secure fit. On the sides of the clamp are two pieces of stock, which extend perpendicular from the sides of the clamp and allow the user a convenient device to pull the clamps off the cans.

On the top surface of the base of the device are recessed rings, which are the diameter of a pint and a quart sized can. This will ensure that the cans will not slip during normal operation as it is being clamped and helps to insure that the cans remain in place during normal use.

A "T" handle at the top of the spindle, which is secured by a hex nut, provides an easy means to carry the device.

BRIEF DESCRIPTION OF THE DRAWINGS

This is a device to carry two cans at one time in a secure fashion. The device is depicted as shown by the following drawings.

DETAILED DESCRIPTION

Figure 1:
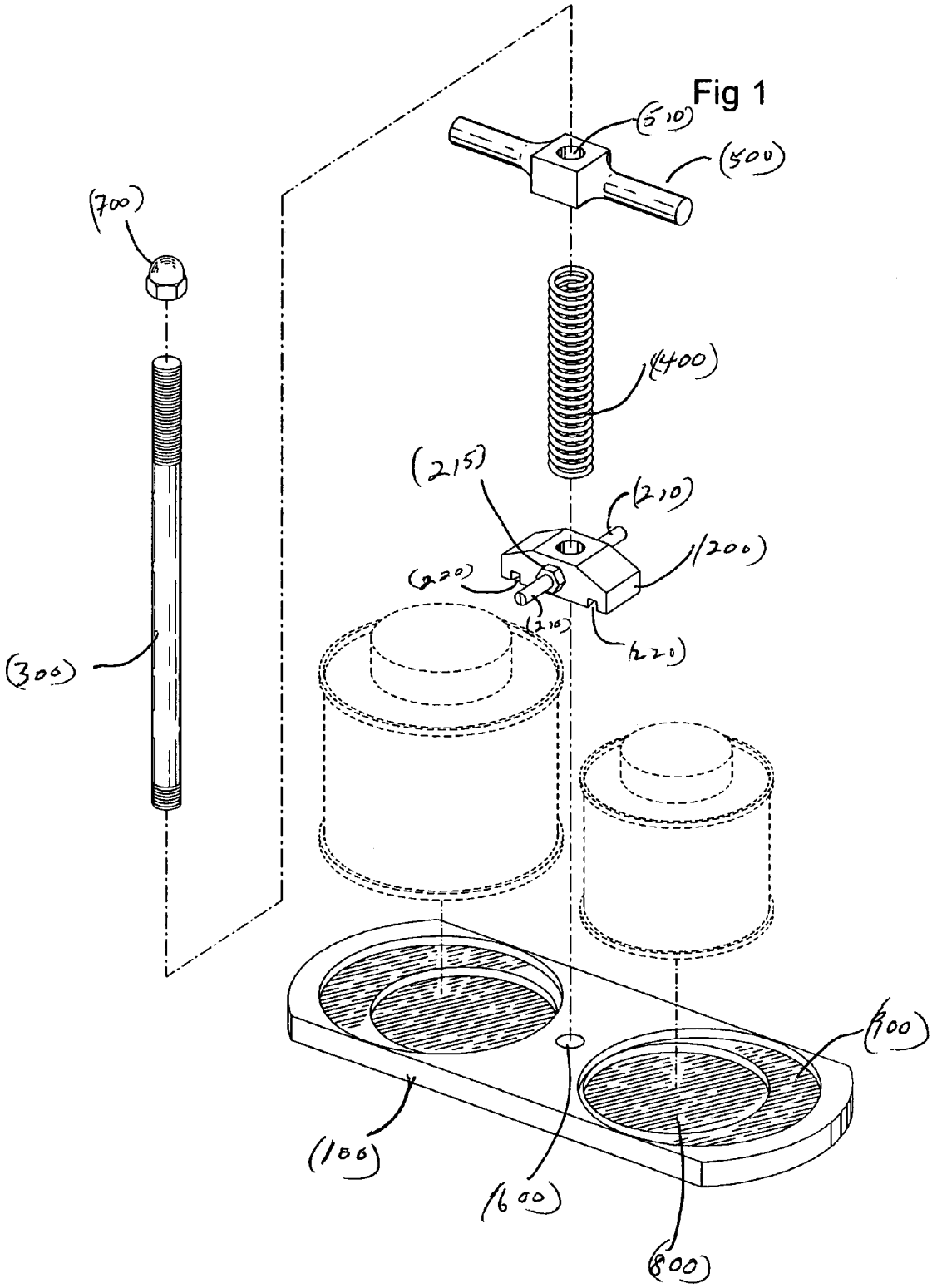
FIG. 1 is an exploded view of the invention
Figure 2:
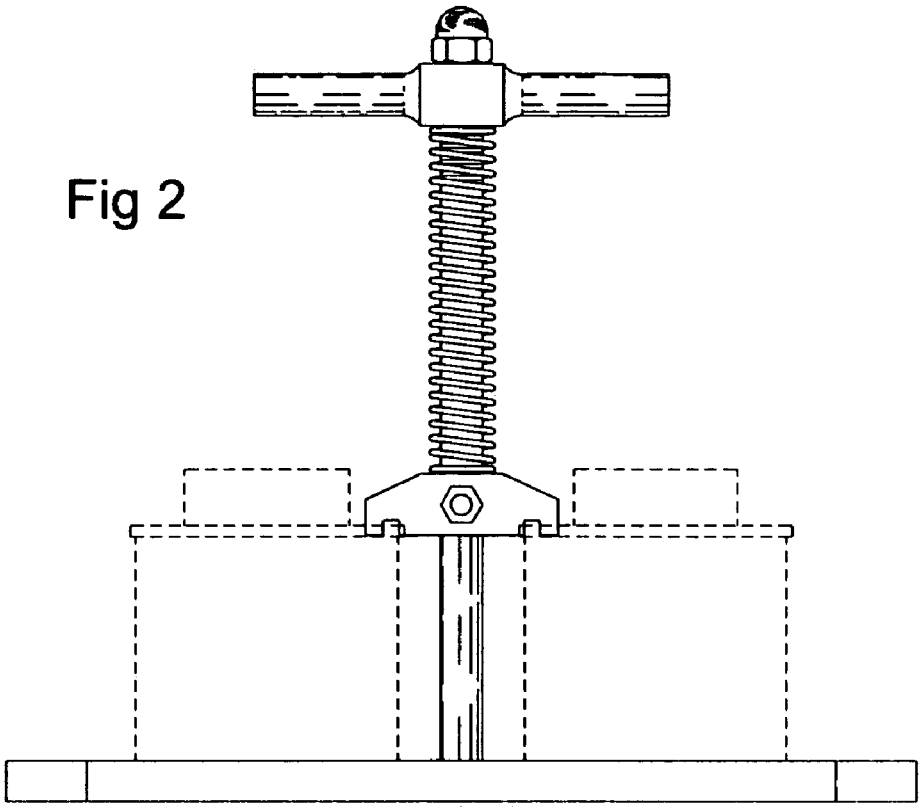
FIG. 2 is a front view of the invention
Figure 3:
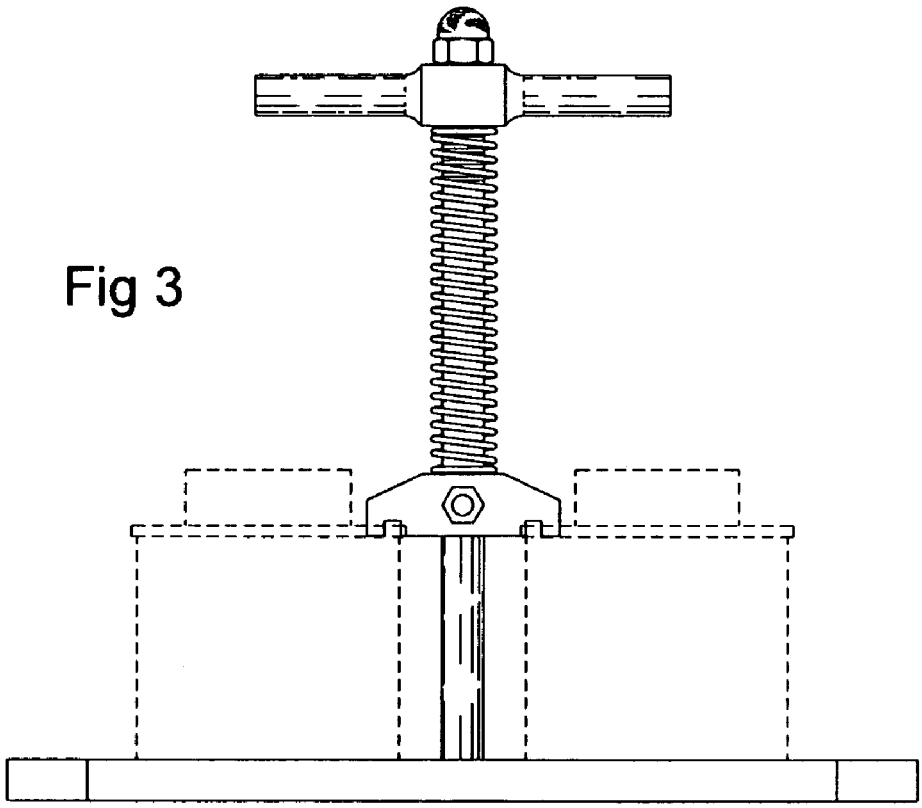
FIG. 3 is a back view of the invention
Figure 4:
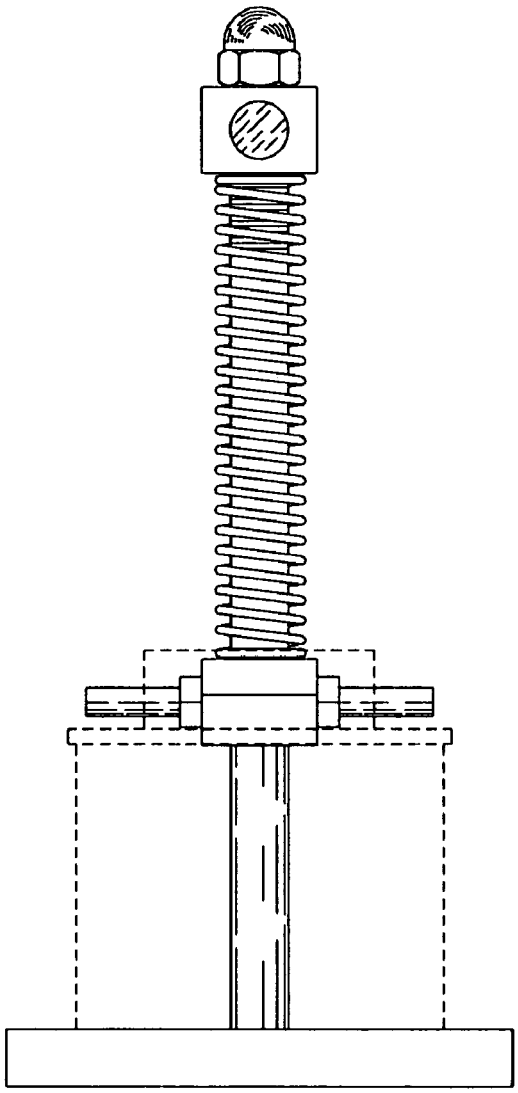
FIG. 4 is a right side view of the invention
Figure 5:
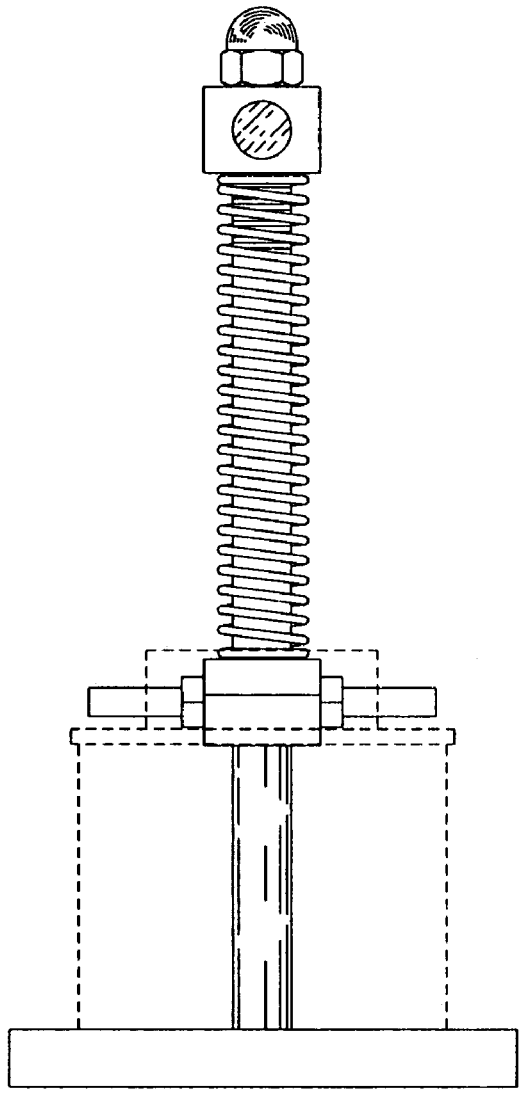
FIG. 5 is a left side view of the invention
Figure 8:
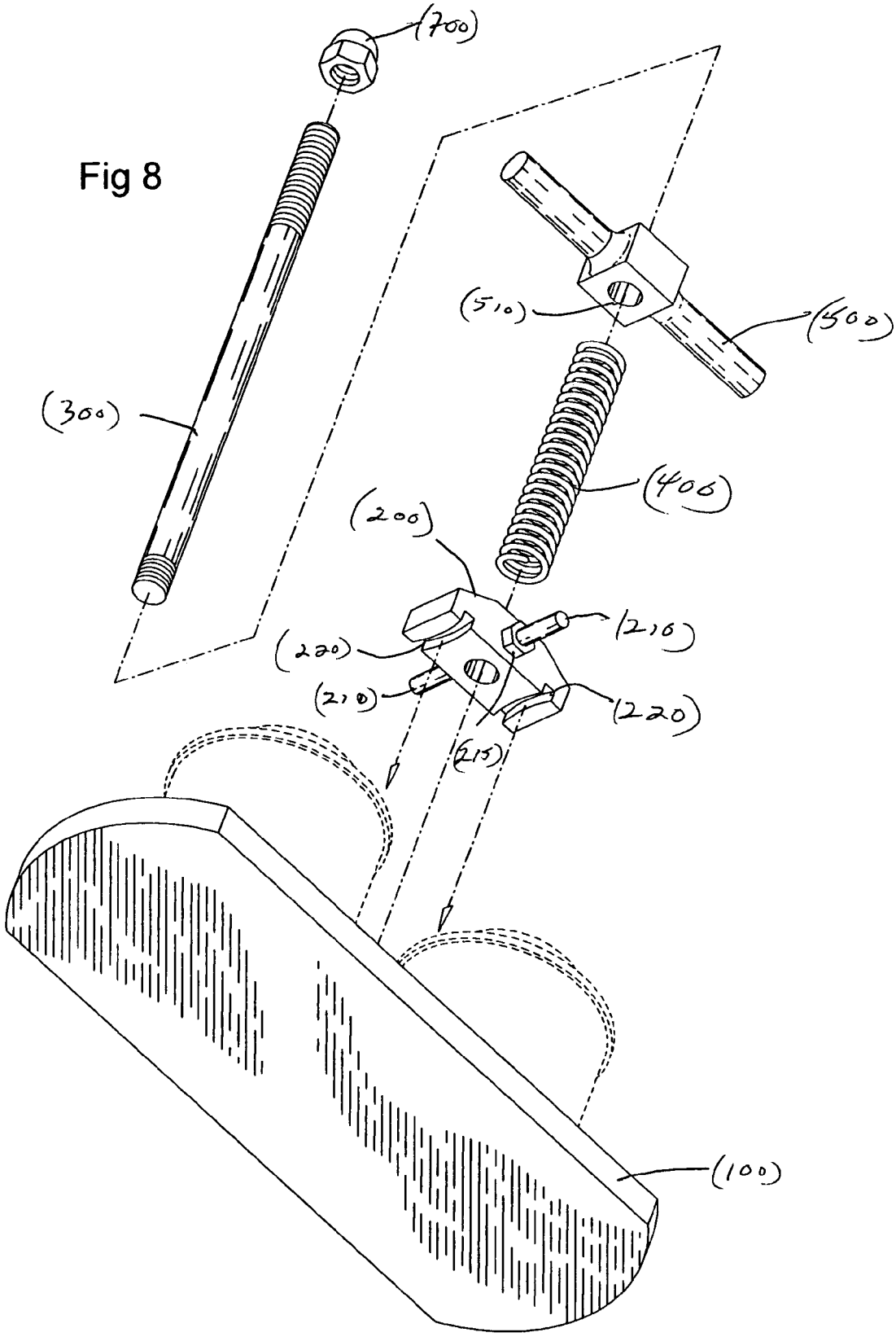
FIG. 8 is an exploded view of the invention depicted from the bottom.

According to FIG. 1 this device consists of a bottom or base section 100, a clamp 200, a spindle 300, which is threaded on both ends, a spring 400 and a T handle 500. The bottom section 100 is approximately 11¾" inches long by one-half inch thick. The bottom section has a width of approximately 4⅜" inches. FIG. 8 is an exploded view of the device and shows the recessed grooves 220 on the underside of the clamp 200.

In the center of the base section there is a tapped and threaded hole 600, which is approximately one-half inch in diameter (FIG. 1).

One end of the threaded spindle 300, is screwed into the hole 600 on the bottom section. The spindle 300 extends through a hole in the center of the clamp 200 and through a hole in the center 510 of the T handle 300. It is secured in place by a hex nut 700.

On the top of the bottom or base section 600 two recessed concentric circles, 800 and 900, are formed on the top surface of the base section. These concentric circles allow a quart and pint jar to be securely positioned in the device. According to FIG. 1, a pint size and quart size can have been drawn to demonstrate the placement within the recessed concentric circles.

The recessed concentric circles 800, 900 are slightly greater than the diameter of the bottom of each of the size cans so that the cans will fit securely in the respective recessed concentric circle on the top surface of the base section of the device. The concentric circles are recessed to a depth of 0.187 inches for the quart size and 0.375 inches for the pint size can.

The indented circle to secure the pint size can 800 is indented to a greater depth so that the bottom of the pint size can will rest flush against the top surface of the base. The indented circle to secure the quart size can 900 is indented to a lesser depth so that the bottom of the quart size can will rest on the top surface of the base. This arrangement of one circle within another gives the appearance of concentric circles, which are offset from each other.

Figure 6:
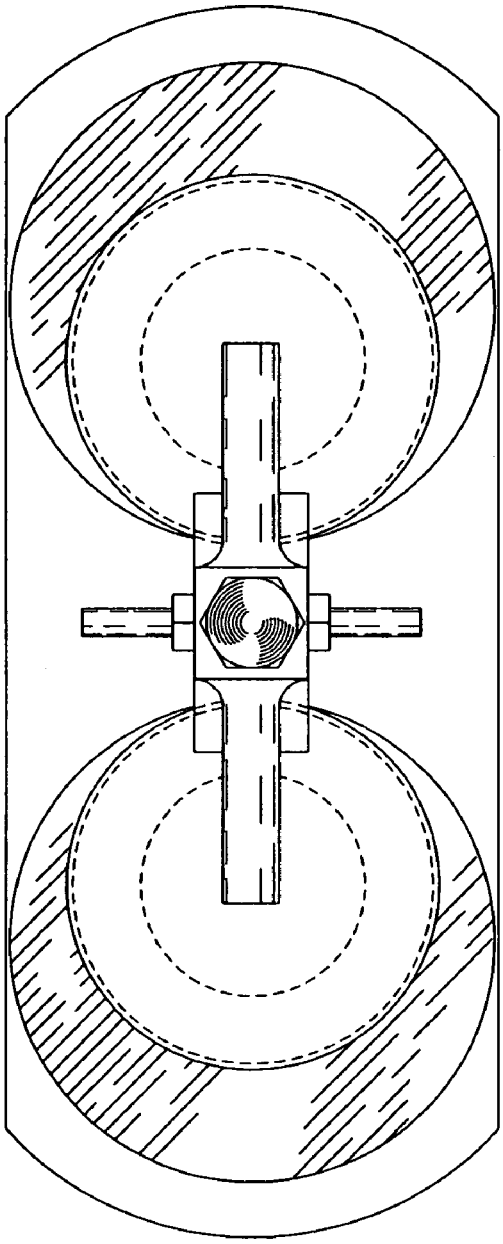
FIG. 6 is a top view of the invention
Figure 7:
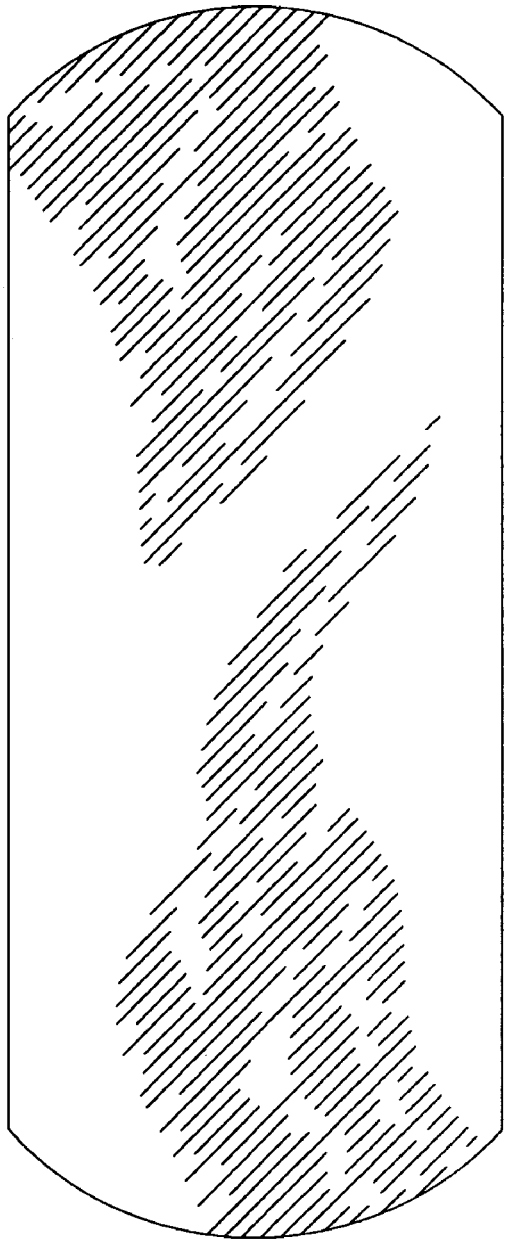
FIG. 7 is a bottom view of the invention

There are two sets of identical recessed concentric circles on each side of the base section as depicted in FIG. 1 and are equally spaced from the midpoint of the base section. FIG. 6 shows a pint size can in place and the recessed ring for the quart size can.

A spindle 300, which is secured in the hole at the bottom of the base section as depicted in FIG. 1 is inserted into the hole 600 which has been tapped and threaded in the center of the base section and the spindle is secured at the top by a hex nut 700. The spindle is approximately 8½" inches long and is threaded at both ends.

The device may be made from a variety of materials, but stainless steel is preferable because it is non-corrosive and durable. It may also be made from aluminum or molded plastic depending on the specific needs of a job.

The spindle is screwed into the hole 600 in the middle of the base section and is inserted through the hole in the center of the clamp 200 and through the hole in the center of the T handle 500. A spring 400 is inserted over the spindle and is positioned between the top surface of the clamp and the bottom surface of the T handle.

The T-shaped handle 500 is approximately 5" inches in length. This will allow the tradesman to pick up this device with one hand.

Between the T-handle and the base section there is a clamp 200 (FIG. 1). A hole in the middle of the clamp allows the spindle to pass through the center of the clamp. The hole in the middle of the clamp is approximately one-half inch in diameter. The spindle is inserted through the middle of the clamp. The clamp freely moves up and down in a vertical fashion once the device is assembled. The clamp is approximately 2 3/16 inches in length. The clamp is equipped with one inch 210 rods, which are inserted into a hole, which has been tapped and threaded on each side of the clamp. A lock nut 215 secures the rods 210 in place. These rods allow the tradesman to pull the clamp up and remove the can(s) easily. The rods 210 extend approximately one inch from the sides of the clamp and are perpendicular to the sides of the clamp.

On the bottom surface of the clamp 200 recessed groves 220 have been placed on the underside of the clamp (FIG. 8). The recessed curved grooves have the following approximate dimensions: 3/16 width, 3/16 diameter with a 1-inch radius. They are approximately 1⅜ inches apart on the underside of the clamp.

The purpose of the recessed grooves 200 is to allow this device to be clamped to the top lid of the can so that the cans are held securely in place by the downward pressure, which is exerted by the spring 400.

Between the top of the clamp 200 and the underside of the T-handle, a compression spring 400 is placed to force the clamp on the top of the cans (FIG. 1). Without this spring the cans would not remain in place.

The specifics of the compression spring are not relevant to this particular patent; however there must be sufficient downward pressure on the cans to ensure a tight and secure placement of the cans in the device.

It is contemplated that this device will be made from durable, non-corrosive materials including but not limited to stainless steel, aluminum and molded plastic.

The invention claimed is:

1. A device, which allows an individual to carry two identically shaped cans in one device and is comprised of the following:

a. a base section;
wherein the base section is planar;
wherein the base section is a predetermined thickness;
wherein the base section has a flat bottom surface;
wherein the base section has a flat top surface with two slightly recessed circles each containing an offset indented circle;
wherein the base section has a tapped and threaded hole in the top surface;
wherein the indented circles are the same distance from the center of tapped and threaded hole;
said recessed indented circles are slightly larger than the diameter of the can being carried;

b. a spindle;
wherein the spindle has a first end and a second end;
wherein the first end and the second end of the spindle is threaded;
wherein the first end of the spindle is secured to the base in the tapped and threaded hole on the top surface;
wherein a means of connection to secure the spindle at the second end is provided;

c. a clamp;
wherein the clamp has a top surface and a bottom surface;
wherein a hole in the middle of the clamp is provided;
said hole in the middle of the clamp is larger than the diameter of the spindle;
wherein recessed grooves are provided on the ends of the clamp;
wherein the recessed grooves are also curved;
wherein the recessed, curved grooves are provided on the bottom side of the clamp;

said recessed, curved grooves fit over the top lip of the can that is carried;

d. a handle;

wherein the handle is provided to carry the device;

wherein a hole in the middle of the handle is provided;

wherein the spindle passes through the hole in the handle;

wherein a means to secure the handle on the spindle is provided;

e. a compression spring;

wherein the compression spring is placed on the top surface of the clamp and the underside of the handle;

wherein the spindle is inserted through the spring.

2. The device as described in claim 1 wherein the two slightly recessed circles are placed on both sides at equal distances from the mid-point of the base section.

3. The device as described in claim 1 wherein one of the indented circles is slightly larger than the diameter of a pint size can.

4. The device as described in claim 1, wherein two pieces of metal, which are threaded into the side of the clamp and secured with a lock nut are installed to allow the user to lift the clamp to remove the cans.

5. The device as described in claim 1 wherein the handle is flared at both ends.

6. The device as described in claim 1 wherein the handle is in the shape of a T.

7. The device as described in claim 6 wherein the compression spring is placed between the underside of the handle and the top surface of the clamp.

8. The device as described in claim 1 wherein the means to secure the handle is a hex nut.

9. The device as described in claim 1 wherein one of the indented circles is slightly larger that the diameter of a quart size can.

* * * * *